US011504579B2

(12) United States Patent
D'Addario et al.

(10) Patent No.: US 11,504,579 B2
(45) Date of Patent: Nov. 22, 2022

(54) HEIGHT AND TENSION ADJUSTABLE HAND EXERCISER

(71) Applicant: D'Addario & Company, Inc., Farmingdale, NY (US)

(72) Inventors: James D'Addario, Old Westbury, NY (US); Andrzej J. Krol, Wayne, NJ (US)

(73) Assignee: D'Addario & Company, Inc., Farmingdale, NY (US)

( * ) Notice: Subject to any disclaimer, the term of this patent is extended or adjusted under 35 U.S.C. 154(b) by 7 days.

(21) Appl. No.: 17/109,526

(22) Filed: Dec. 2, 2020

(65) Prior Publication Data

US 2021/0162259 A1 Jun. 3, 2021

Related U.S. Application Data

(60) Provisional application No. 62/942,270, filed on Dec. 2, 2019.

(51) Int. Cl.

| | |
|---|---|
| ***A63B 23/16*** | (2006.01) |
| ***A63B 21/02*** | (2006.01) |
| ***A63B 21/00*** | (2006.01) |
| ***A63B 21/05*** | (2006.01) |

(52) U.S. Cl.

CPC ..... *A63B 23/16* (2013.01); *A63B 21/00069* (2013.01); *A63B 21/023* (2013.01); *A63B 21/05* (2013.01); *A63B 2225/09* (2013.01)

(58) Field of Classification Search

CPC . A63B 21/04; A63B 21/0414; A63B 21/0428; A63B 21/0442; A63B 21/00069; A63B 21/023; A63B 21/05; A63B 21/008; A63B 21/0083; A63B 21/0085; A63B 21/0087; A63B 21/4045; A63B 21/4035; A63B 2225/09; A63B 23/16

See application file for complete search history.

(56) References Cited

U.S. PATENT DOCUMENTS

| | | | | |
|---|---|---|---|---|
| 1,136,481 | A * | 4/1915 | Ostrovsky | G09B 15/06 84/465 |
| 3,216,412 | A | 11/1965 | Houle | |
| 3,447,415 | A | 6/1969 | Kime | |
| 3,738,651 | A | 6/1973 | Norman et al. | |
| 4,350,335 | A | 9/1982 | Pasbrig | |
| 4,609,191 | A | 9/1986 | Remme | |

(Continued)

*Primary Examiner* — Erin Deery
*Assistant Examiner* — Peter H Forstner
(74) *Attorney, Agent, or Firm* — Alix, Yale & Ristas, LLP

(57) ABSTRACT

An exercise device for compression exercises is adjustable in height and in compression force. The device includes a central housing and a plurality of plungers extending from a top side. A support member is attached to the housing on a bottom side. The support member is movable longitudinally relative to the housing and plungers from a fully retracted position to a fully extended position and is lockable in a plurality of intermediate longitudinal positions to vary the height of the device. Each plunger is operatively associated with an internal bias member that biases the plunger away from the housing. Resistance force on a plunger is adjustable via changing tension of the associated bias member with an adjustment knob to finely adjust tension. An installed bias member is removable and replaceable with a different bias member to coarsely adjust tension.

20 Claims, 10 Drawing Sheets

(56) References Cited

U.S. PATENT DOCUMENTS

| | | | | |
|---|---|---|---|---|
| 4,678,181 | A | 7/1987 | Ditsch et al. | |
| 4,765,608 | A | 8/1988 | Bonasera | |
| 5,147,256 | A * | 9/1992 | Silagy | A63B 23/16 482/49 |
| 5,156,581 | A | 10/1992 | Chow | |
| 5,425,690 | A | 6/1995 | Chang | |
| 5,431,611 | A * | 7/1995 | Silagy | A63B 23/16 482/122 |
| 5,690,585 | A | 11/1997 | Ditsch | |
| 6,036,621 | A | 3/2000 | Hancock | |
| 6,443,874 | B1 | 9/2002 | Bennett | |
| 6,537,075 | B1 | 3/2003 | Valero-Cuevas | |
| 6,673,026 | B2 | 1/2004 | Pozos et al. | |
| 6,746,373 | B1 | 6/2004 | Bohmer | |
| 7,351,897 | B2 | 4/2008 | Woods | |
| 7,967,732 | B2 * | 6/2011 | D'Addario | A63B 21/023 482/44 |
| 9,005,084 | B2 | 4/2015 | Silagy et al. | |
| 9,072,939 | B2 * | 7/2015 | Silagy | A63B 21/0552 |
| 9,114,280 | B2 | 8/2015 | Silagy et al. | |
| 9,421,419 | B1 | 8/2016 | Goldberg | |
| 9,474,932 | B1 * | 10/2016 | Goldberg | A63B 21/023 |
| 9,597,547 | B1 * | 3/2017 | Goldberg | A63B 21/05 |
| 9,700,758 | B1 | 7/2017 | Goldberg | |
| 10,596,413 | B2 * | 3/2020 | Zerbo | A63B 23/16 |
| 2003/0131710 | A1 | 7/2003 | Goldiner | |

* cited by examiner

HEIGHT AND TENSION ADJUSTABLE HAND EXERCISER

BACKGROUND OF THE DISCLOSURE

The present disclosure relates to finger and hand exercising devices. More particularly, the disclosure relates to a finger and hand exerciser that is adjustable in height and in force of resistance.

Exercise devices exist that provide for numerous different types of hand and finger exercises, including compression and extension exercises. These such devices are used for a variety of purposes and in many different settings. Non-limiting examples include patients in medical and therapy settings, such as for rehabilitation from an injury or surgery, and athletes and musicians for strength and flexibility training.

One variety of hand exercise device that provides compression exercises includes a base that fits in a user's palm and a plurality of pistons or plungers that are biased upward and configured to be compressed inward by a user's fingers to perform the exercises. Some devices provide for adjustment of the specific tension of bias members (such as compressed springs) within the plungers so that a user can vary the resistance in each plunger. In this sense, each plunger can provide a range of resistance profiles by compressing or relaxing its internal spring. An exemplary premium product is manufactured and sold by D'Addario & Company, Inc. as the Varigrip® hand exerciser and disclosed and claimed in co-owned U.S. Pat. No. 7,967,732. The Varigrip® hand exerciser utilizes a disc threaded to a rod for adjusting tension on a compression spring providing a biasing force on a plunger. The compression spring is sandwiched between the disc and an upper surface. As the disc is rotated in opposite directions, it travels upward or downward on the rod between a maximum height/maximum resistance position and a minimum height/minimum resistance position. Known devices, including the Varigrip® hand exerciser, utilize a base housing for containing operative elements with a bottom that serves as a palm support during use. In such devices, the distance between the palm support and the top of the plungers, and thus the size of the device, is fixed. Additionally, the inner springs are permanently housed within the device and not removable, so the range between maximum and minimum resistances for each finger is limited to that which an installed spring can offer.

While varying the resistance in the manner described above is extremely useful for performing different exercises and building strength over time, it would be even more useful to have a hand exercise product that provides a wider range of resistances, which can provide both fine (internal) adjustment and coarse (external/spring replacement) adjustment without requiring tooling. It would also be useful to provide an exercise device that is adjustable in height such that a single device can accommodate individuals having a wide range of hand sizes.

SUMMARY

In one embodiment, a hand exercise device includes a central housing, a plurality of plungers and a support member. The plungers extend longitudinally from a top side of the housing and are compressible into the housing against a bias force. The support member is connected to the housing at a bottom side opposite from the plungers and is longitudinally slidable relative to the housing between a fully retracted position and a fully extended position. The bottom support is optionally lockable in an intermediate position longitudinally between the fully retracted position and the fully extended position.

In another embodiment, an exercise device comprises a housing that defines one or more elongate chambers and one or more compressible plungers. Each compressible plunger extends from the housing in a longitudinal direction in operable communication with one elongate chamber and is biased away from the housing. A tension adjustment member is operatively associated with each compressible plunger for varying the bias force on the respective plunger. A bottom support member is connected to the housing on a longitudinally opposite side from the one or more compressible plungers. The longitudinal position of the bottom support member relative to the one or more compressible plungers is adjustable and the bottom support member is lockable in a plurality of different longitudinal positions relative to the housing.

In yet another embodiment, an exercise device includes a housing defining a plurality of longitudinally elongate chambers and a plunger associated with each elongate chamber. Each plunger is longitudinally compressible into the housing and is in operable communication with an elongate chamber. A bias member is positioned within each elongate chamber in operable communication with a plunger to bias the respective plunger away from the housing. A tension adjustment member is operatively associated with each bias member for varying tension of the respective bias member to vary a force required to compress the respective plunger into the housing. A support member is connected to the housing on a side longitudinally opposite from the one or more compressible plungers. At least a portion of each plunger is detachable to expose the associated elongate chamber and remove the associated bias member from the housing. The bottom support member is longitudinally slidable relative to the housing and lockable in a plurality of different longitudinal positions relative to the housing.

In some embodiments, a cap on one or more plungers is removable to expose a hard, rough surface.

In summary, the disclosed inventive embodiments of the hand exerciser carry the following unique features:

- Size adjustable without requiring any tools or disassembly.
- Both fine internal adjustment of resistance force (i.e., tension adjustment knob) and coarse external adjustment of resistance (i.e., replacement of springs).
- Allows users to independently exercise each finger with a wide variety of resistance forces while customizing to a wide variety of hand sizes.
- Usable for strength training and in rehabilitation settings.
- Provides optional callus-building exercises.

BRIEF DESCRIPTION OF THE DRAWINGS

Aspects of the preferred embodiment will be described with reference to the drawings, where like numerals reflect like elements.

DETAILED DESCRIPTION

Figure 1:
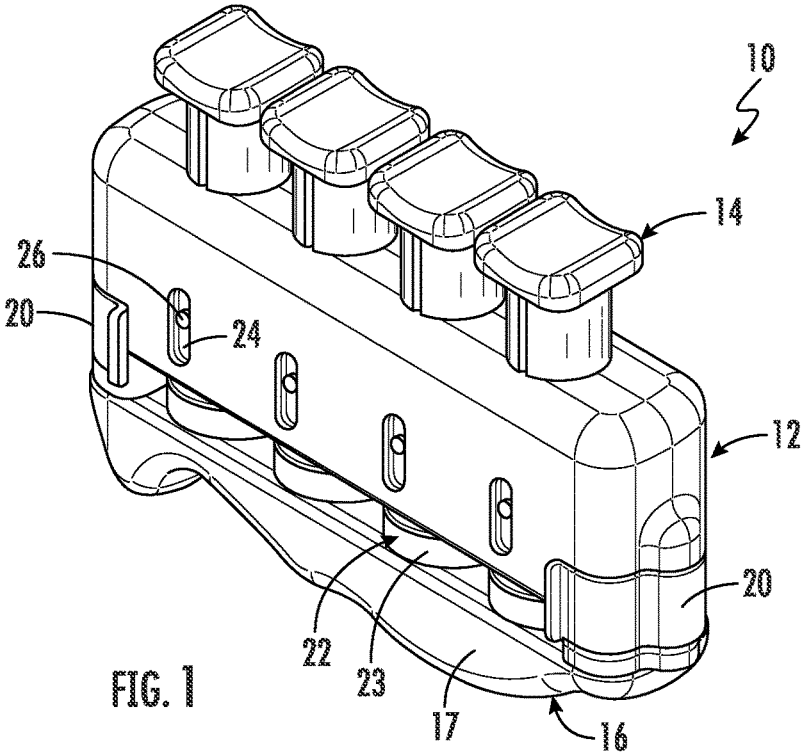
FIG. 1 is a perspective view of an embodiment of the exercise device according to the disclosure in a retracted minimum height position.

Among the benefits and improvements disclosed herein, other objects and advantages of the disclosed embodiments will become apparent from the following wherein like numerals represent like parts throughout the several figures. Detailed embodiments of a height- and tension-adjustable hand exercise device are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the Figures, an adjustable exercise device 10 is shown and described. Most generally, the device 10 includes an intermediately positioned body or housing 12 with a plurality of resistance plungers 14 communicatively attached on one side and a palm support member 16 engaged on the opposite side. The plungers 14 project from the top end of the housing 12 and are engaged in a slidable and reciprocating relationship relative to the housing. Each plunger 14 is biased toward an expanded position (i.e., upward in FIGS. 1 and 2) independent from the other plungers, such that they may be independently compressed into the housing by a user against the bias. As a user relaxes pressure on a compressed plunger, the plunger returns to its expanded position under the return force of an internal spring.

Figure 2:
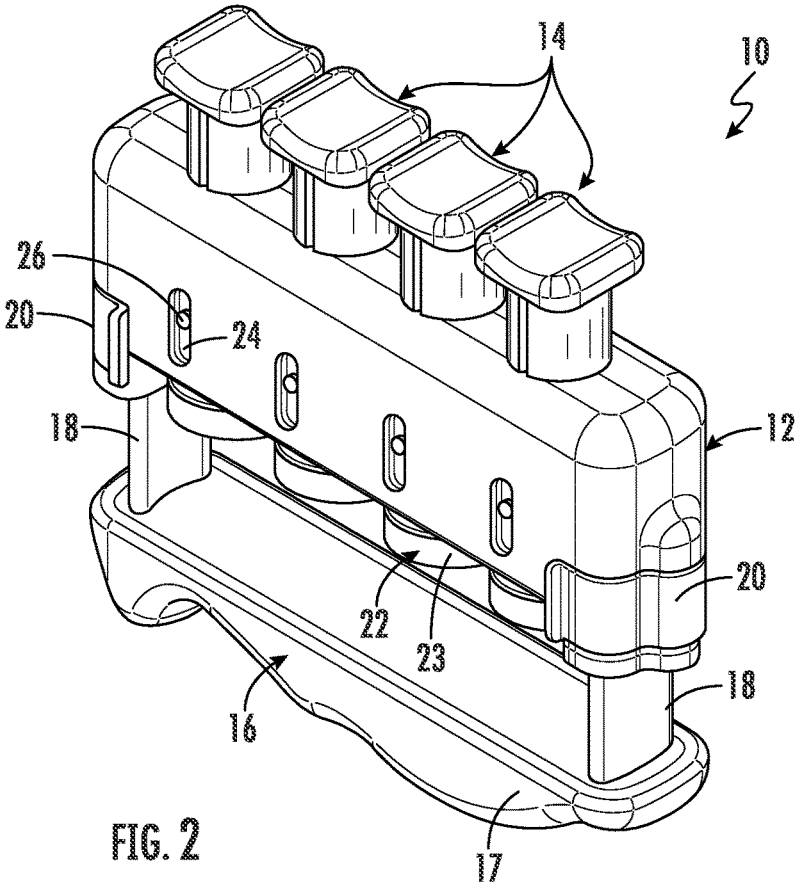
FIG. 2 is a perspective view of the exercise device of FIG. 1 in an expanded maximum height position.

In the embodiment shown in FIGS. 1-5, the support member 16 includes a pair of opposite elongate rails 18 with each rail 18 retained relative to the housing 12 within an longitudinally elongate channel 50 having a complimentary shape by a lockable and releasable cam 20. As shown in FIG. 2, the rails 18 may have a curved or bowed contour to aid in locking via the cams 20. The support member 16 may carry an outer pad 17 made from a resilient slip-resistant material for comfort. In FIGS. 1 and 2, the cams 20 are both shown in a locked position that prevents the rails 18 from sliding in the channels 50, and thus, the support member 16 from moving relative to the housing 12. The device 10 also includes a tension adjuster 22 with a rotatable knob 23 associated with each plunger 14, wherein each knob 23 is accessible from the exterior of the housing 12. Preferably, the housing 12 also defines a viewing window or slot 24 associated with each plunger 14 from which a tension indicator 26 is viewable.

Figure 3:
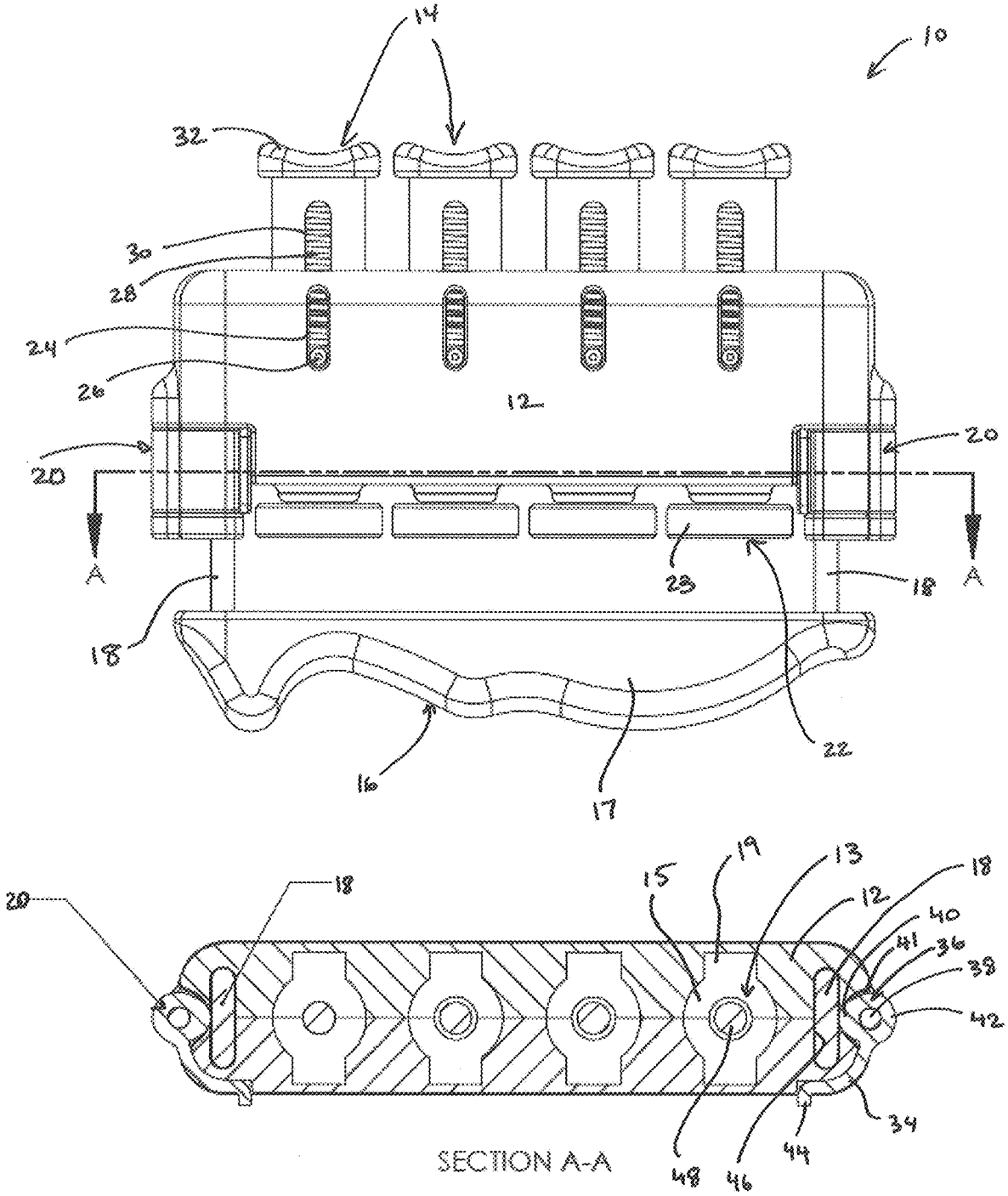
FIG. 3 is a side elevation view and associated section view of the disclosed exercise device with locking cams in a tightened position.

FIG. 3 shows a more detailed view of the exercise device 10 with the locking cams 20 in the locked position (also referred to as the tightened position or closed position). In the top portion of FIG. 3, bias members 28 in the form of compression springs can be seen through the slots 24 and side windows 30 in each plunger body. The plungers 14 may each carry a finger cap 32 with ergonomic contour, such as the concave top surfaces shown which act as finger receptacles. These caps 32 may be made of a resilient slip-resistant material, such as silicone. Alternatively, a resilient pad cover may be positioned on the caps. The support member 16 is shown in an intermediate position, with rails 18 partially retracted into the housing 12.

Figure 5:
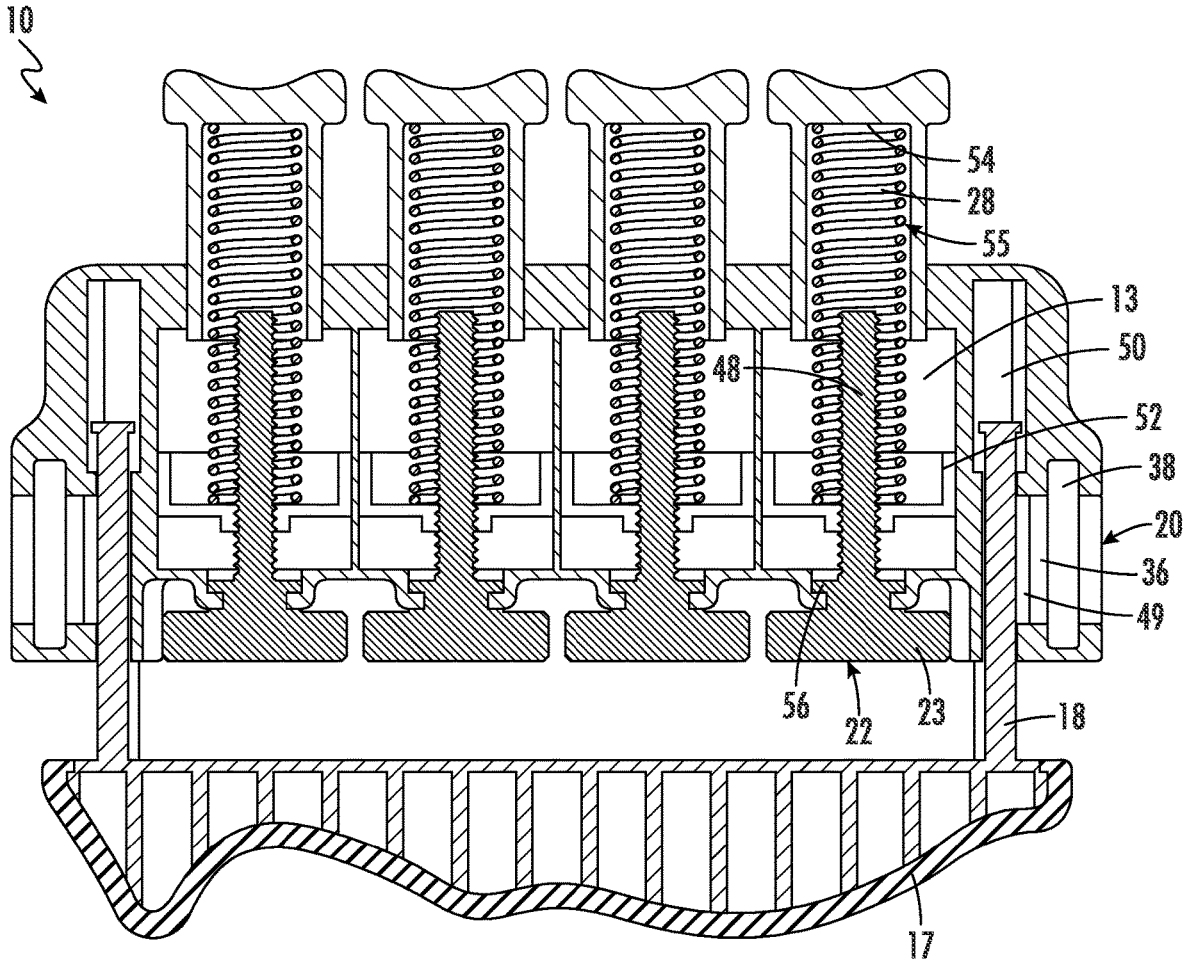
FIG. 5 is a section view of the disclosed exercise device.

In the cross-sectional view in the lower portion of FIG. 3, it can be appreciated that each cam 20 has a lever 34 extending from an irregularly shaped cam lobe 36 that is retained in the housing 12 with a pin 38 in a rotatable engagement. It can also be appreciated that the cam lobe 36 has an approximately egg-shaped cross section with a nose 40 and an opposite heel 42. As shown, the nose 40 defines an outer surface that extends radially further from the pin 38 than the outer surface defined by the heel 42 with a transition ramp 41 circumferentially between the nose and heel. In the depicted embodiment, the lever 34 has a curved contour to correspond with that of the body 12 and may carry a distal foot 44 to assist gripping and operation by a user. As shown, in the locked position depicted in FIG. 3, the lever 34 is pivoted inward, causing the surface on the nose 40 to tighten against the rail 18 of the support member 16 and trap the rail against an opposite surface 46 of the housing, thereby locking the support member 16 longitudinally relative to the housing 12 and plungers 14. As shown in FIG. 5, a resilient friction member 49 formed from silicone or rubber, for example, may be positioned in a small space between the cam lobe 36 and rail 18 to assist locking the rail in position and prevent movement. As will be discussed further, the rails can be locked in any longitudinal position between a fully expanded position and a fully retracted position.

Figure 4:
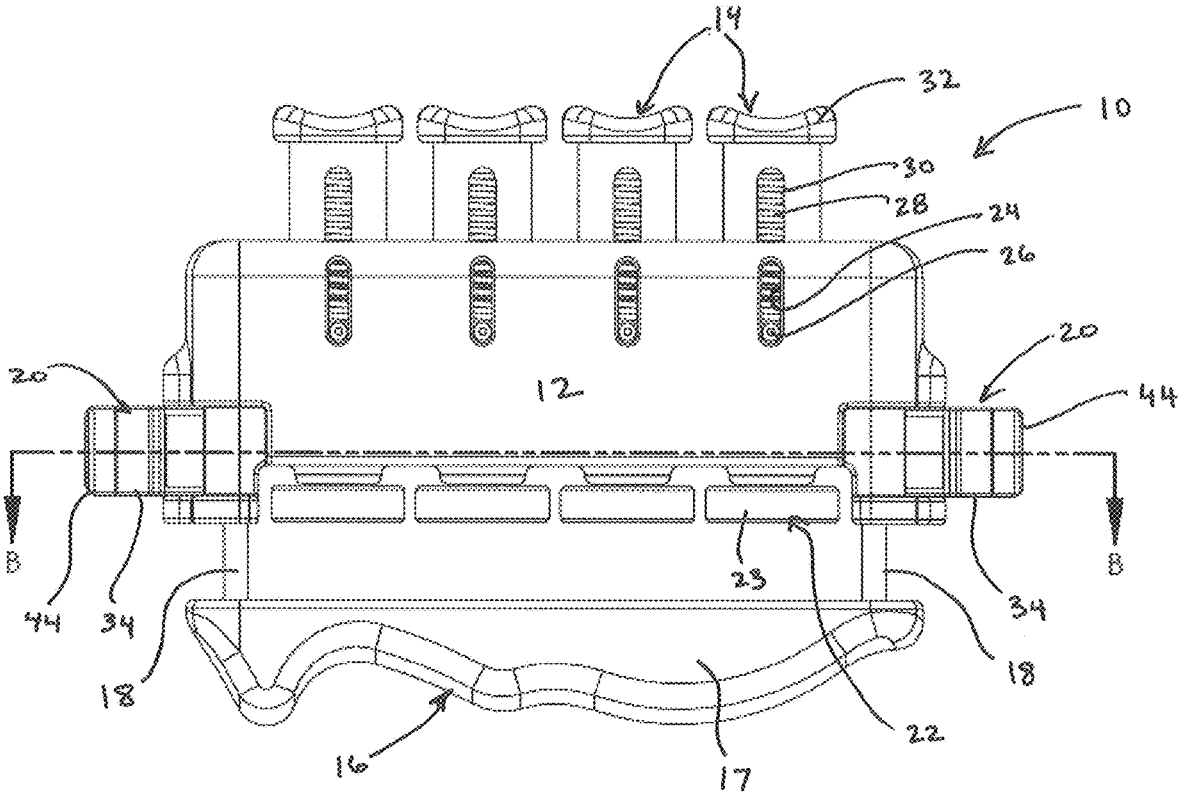
FIG. 4 is a side elevation view and associated section view of the disclosed exercise device with locking cams in a loosened position.
Figure 4:
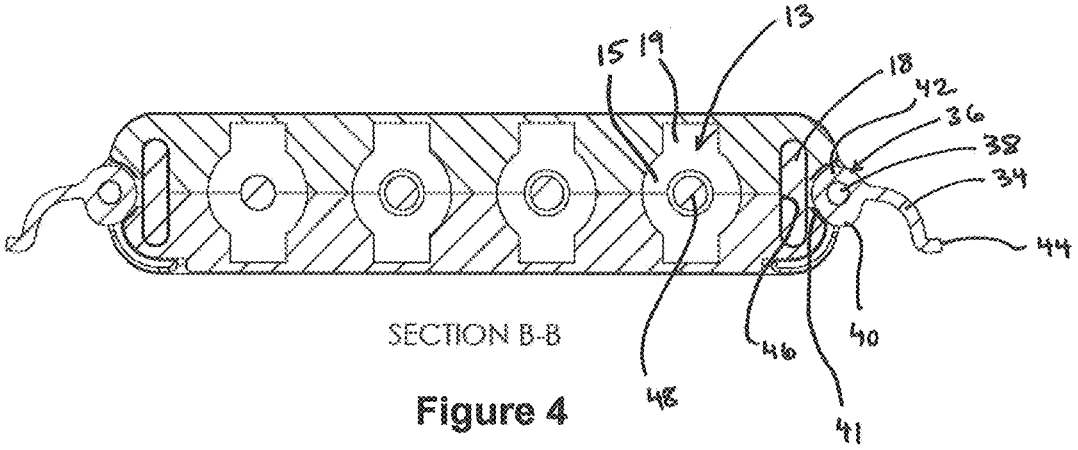

FIG. 4 shows views of the exercise device 10 with both cams 20 in an unlocked position (also referred to as the loosened position or opened position). In the unlocked position, the cam 20 is pivoted about the pin 38 by rotating the lever 34 away from the housing 12. This can be seen most clearly in the lower drawing of FIG. 4 wherein the left cam has been pivoted clockwise and the right cam has been pivoted counterclockwise. In the unlocked position, the lobe 36 is rotationally aligned with the ramp 41 (or possibly the heel 42) facing the rail 18. This positioning releases pressure between the lobe 36 and the rail 18 which allows the rail to longitudinally slide within the channel 50 defined within the body 12. In use, a user may adjust the height of the exercise device 10 quickly and simply by unlocking both of the cams 20, sliding the support member 16 to a preferred longitudinal location to yield on exerciser of a preferred size, and then the locking the cams 20.

Additional notable elements and relationships of the device 10 are shown clearly in the cross-sectional view of FIG. 5. Each tension adjuster 22 includes a threaded post 48 projecting longitudinally upward from the knob 23 into a respective housing chamber 13 with an annular shoulder 56 extending radially outward and positioned longitudinally between the knob 23 and post 48. As shown, the annular shoulder 56 is retained in a slot formed in the housing having a complimentary shape with the threaded post 48 extending upward into the housing. A resistance disc 52 with a central threaded bore is positioned within each respective chamber 13 and is threaded to the post 48. Each resistance disc traps a bias member 28 (i.e., compressed coil spring) with an upper abutment surface 54 of the plunger 14. The bias member extends through the housing chamber 13 and an aligned chamber 55 defined within each plunger. Each resistance disc is longitudinally movable and rotationally fixed relative to the housing 12 within its housing chamber 13. As shown in the top cross-sectional views in FIGS. 3 and 4, each housing chamber 13 defines a round central section 15 and one or more radially extending sections 19 which receive a similarly shaped radially extending nub (not depicted) of the resistance disc 52 to prevent rotation of the resistance disc as the threaded post 48 rotates, thus allowing the resistance disc to travel longitudinally within the chamber 13 up or down the post. The tension of each bias member 28 and the resulting resistance force on the associated plunger 14 can thus be adjusted by rotating the knob 23, causing the resistance disc 52 to travel longitudinally along the post 48. Adjustment of tension via the tension adjusters 22 is referred to herein as "fine adjustment." For example, rotation of the knob 23 in a first direction causes the disc 52 to travel upwards, which compresses the bias member 28 further, thereby increasing the spring tension and increasing the force required to compress the plunger 14 downward. Rotation of the knob 23 in the opposite direction causes the resistance disc 52 to travel downward along the post 48, which releases tension in the spring 28, thus reducing the force necessary to compress the plunger 14.

As described in the preceding paragraph, the exercise device 10 allows fine internal adjustment of tension on each plunger 14 independent of one another by using the tension adjusters 22 to compress or relax the individual springs installed within a given housing chamber 13. The device 10 is further adjustable by disengaging each plunger 14 from the housing 12 or disengaging finger caps 32 from plunger bodies to expose the chamber 13 and release the individual spring 28 contained therein. Adjustment of tension by spring replacement is referred to as external "coarse adjustment." In this manner, a first spring having a first tension profile can be replaced with a second spring with a different tension profile. Numerous sets of springs may be included and optionally color-coded to correspond to a given strength and level of tension. For example, in one preferred embodiment, the device can be provided with a set of four green springs of a first (low) tension, a set of four yellow springs of a second (medium) tension, and a set of four red springs of a third (high) tension. Once installed within the housing with a plunger and finger cap attached, each spring is further adjustable via the adjustment member 22 (fine adjustment), as described above. In this manner, springs of one tension can be exchanged with other springs having different tension profiles and further adjusted once installed to provide a virtually limitless range of tension options for each plunger.

Another embodiment of the height- and tension-adjustable hand exerciser is disclosed as reference numeral 110 in FIGS. 6-13. Many elements in the device 110 are the same or substantially similar to elements in the device 10, including most notably, the general aspects of internal "fine" tension adjustment provided by the knobs 123, threaded post 148, and tension adjustment disc 152, and a tension indicator 126. Additionally, the device 110 is coarsely adjustable in the same general manner as the earlier embodiment of the device 10 via disengagement of plungers 114 from the housing or disengagement of the finger caps 132 from the plungers to expose the bias member 128 for removal and replacement.

Figure 6:
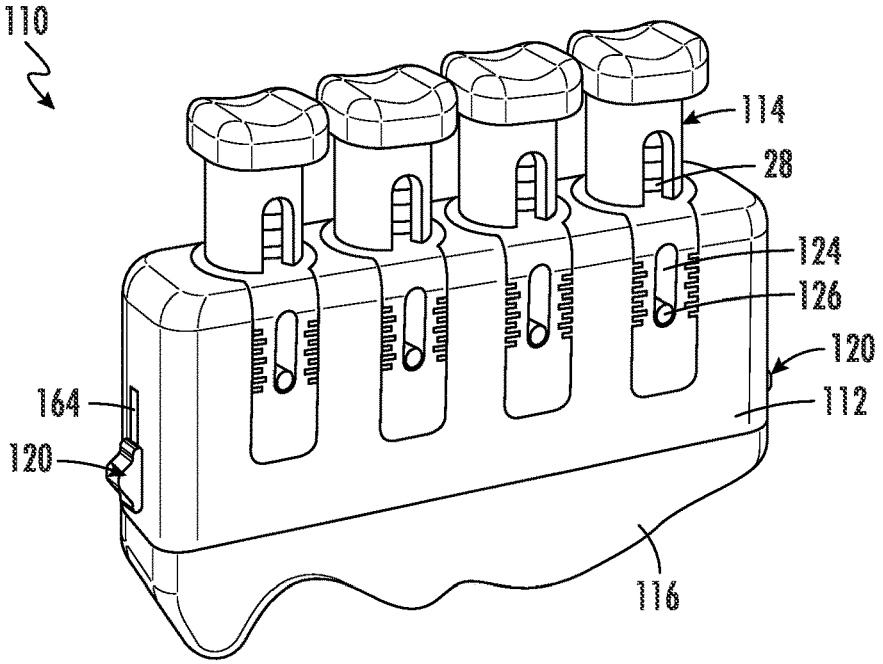
FIG. 6 is a perspective view of another embodiment of the disclosed exercise device in a retracted minimum height position.
Figure 7:
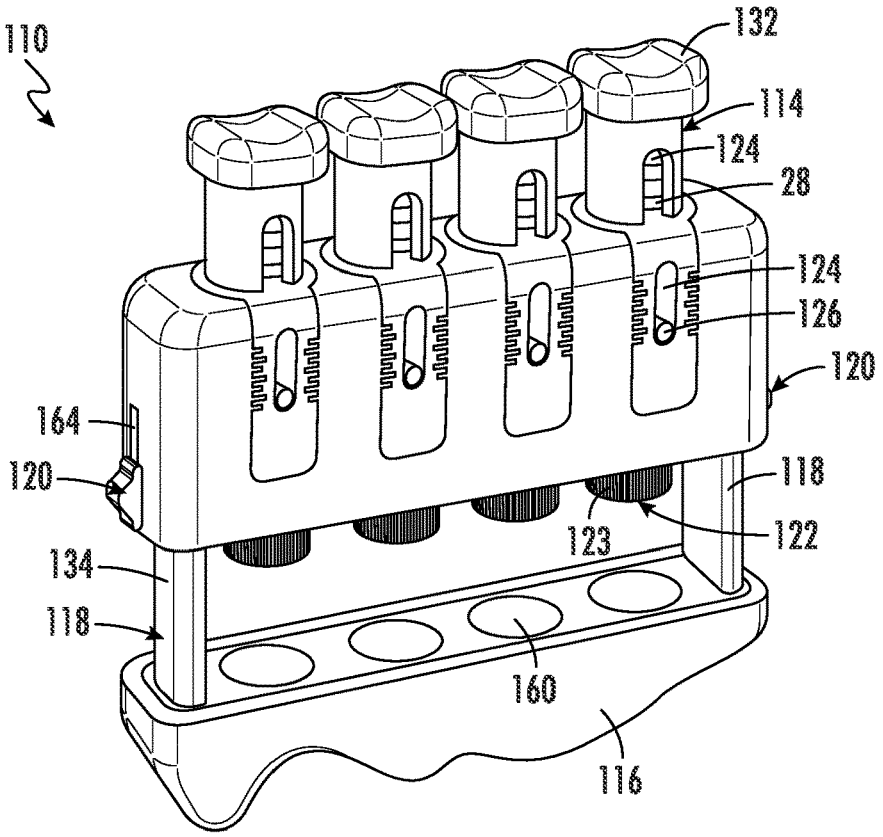
FIG. 7 is a perspective view of the exercise device of FIG. 6 in an expanded maximum height position.
Figure 8:
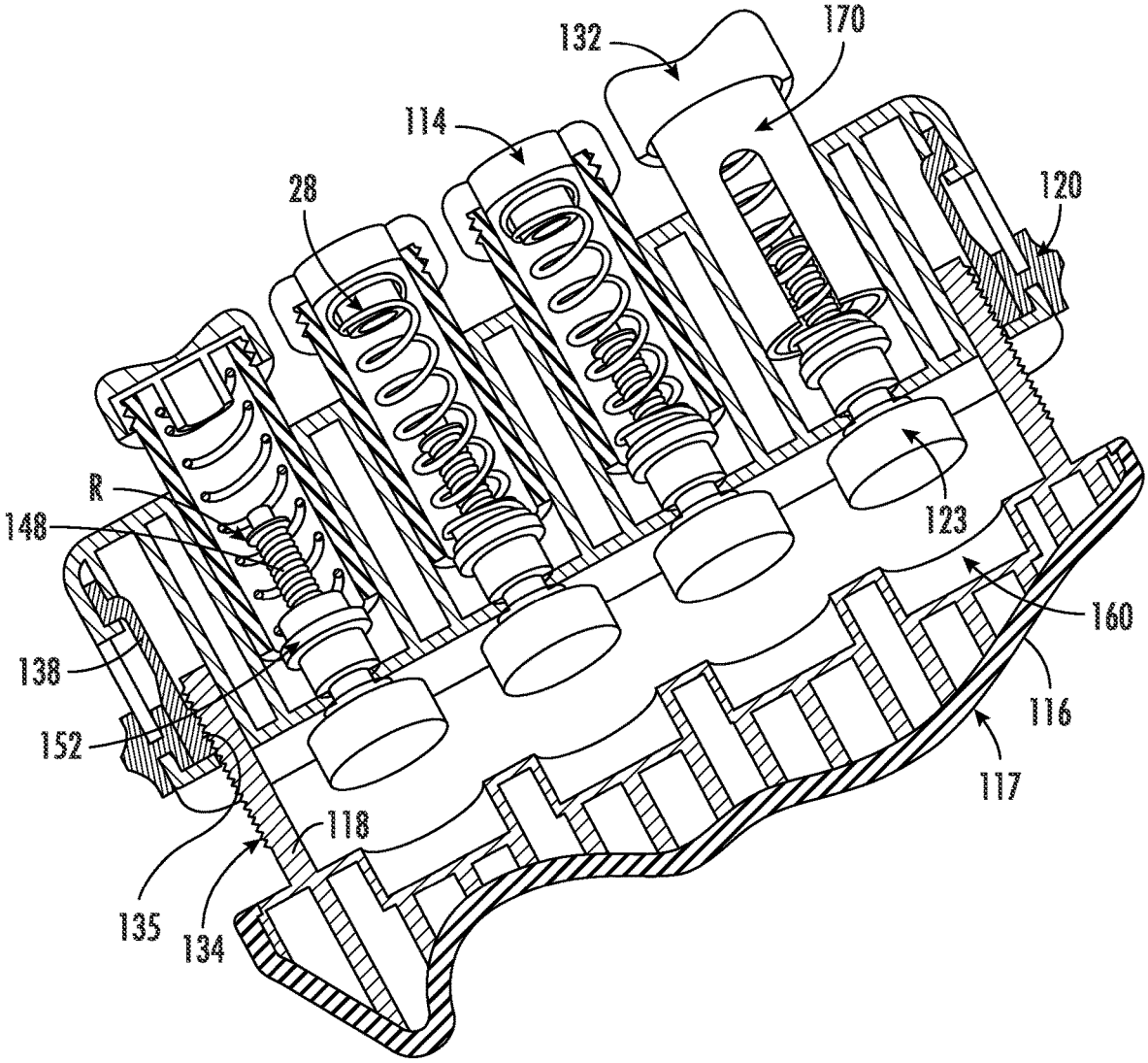
FIG. 8 is a partial sectional view of the exercise device of FIG. 6.
Figure 9:
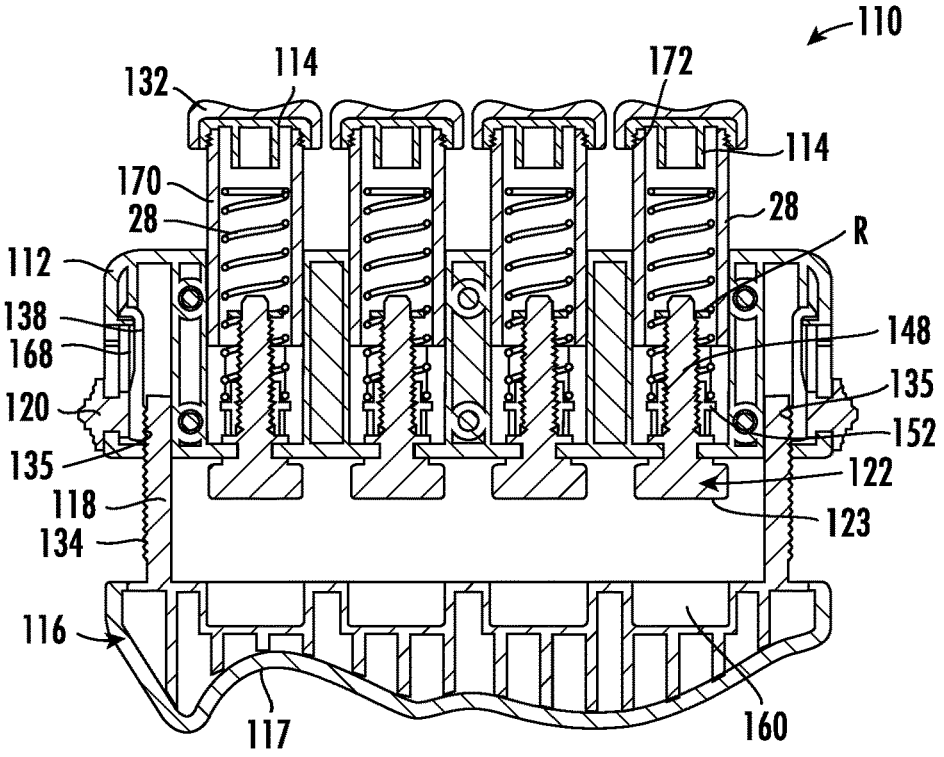
FIG. 9 is a sectional view of the exercise device of FIG. 6 in the expanded maximum height position.
Figure 10:
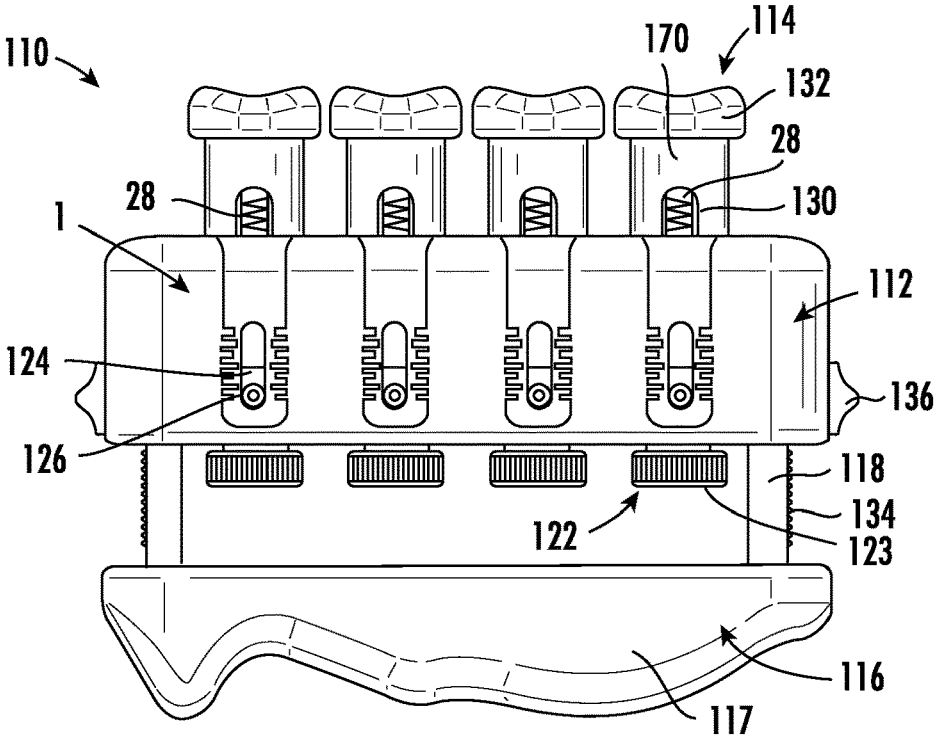
FIG. 10 is a front elevation view of the exercise device of FIG. 6 in the expanded maximum height position.
Figure 11:
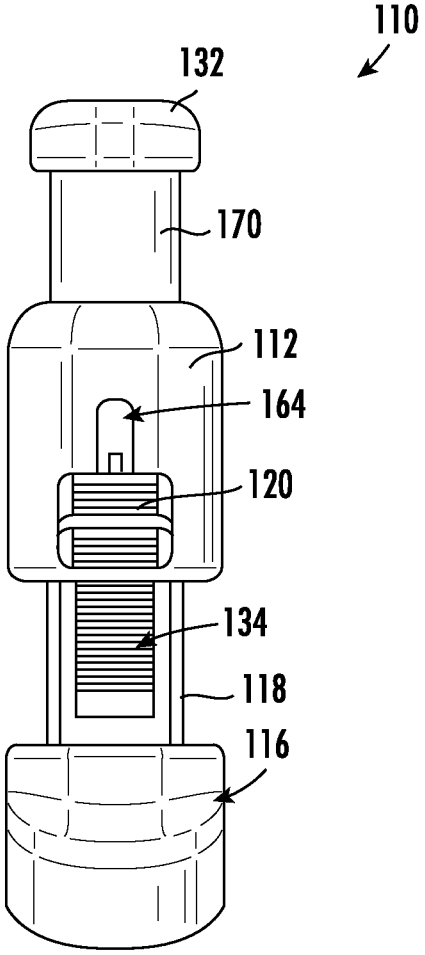
FIG. 11 is a side elevation view of the exercise device of FIG. 6 in the expanded maximum height position

However, the device 110 includes a locking slider 120 that operates to lock and unlock a ratchet assembly 136 on each side of the housing 112 in place of the locking cams of the earlier embodiment. Additionally, the palm support member 116 includes a set of recesses 160 in its upper surface that correspond to the respective knobs 123 of the spring tension adjusters 122. As can be seen in FIG. 6, the palm support member 116 is retractable toward the housing 112 such that the top surface of the support member abuts the bottom surface of the housing with each knob 123 received within a recess 160, concealing the knobs.

Figure 12:
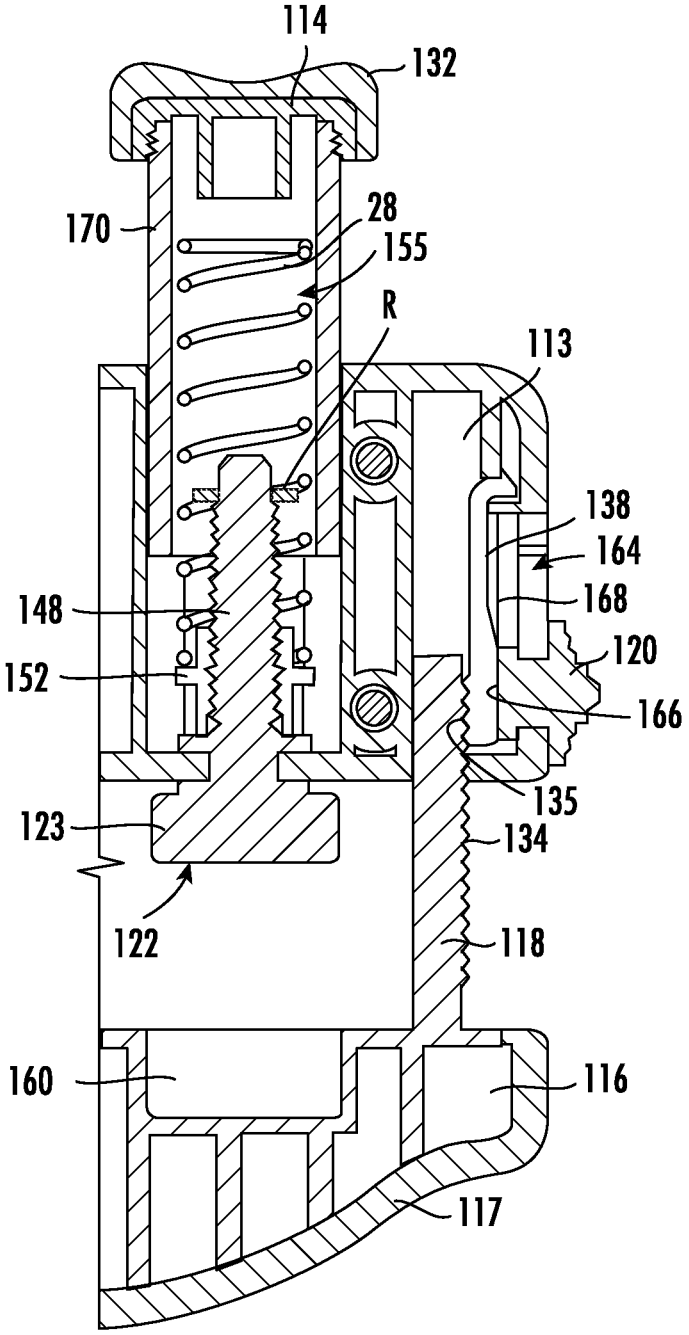
FIG. 12 is an enlarged sectional view of the height adjustment mechanism of the exercise device of FIG. 6.

Key elements of the ratchet mechanism and its operation can be appreciated with reference to FIGS. 8-12, and especially to the enlarged view of FIG. 12. A ratchet arm 138 is attached within the housing 112 and extends from a top portion to a bottom portion that carries a set of ratchet teeth 135. Each rail 118 of the palm support 116 includes a series of teeth 134 that are complimentary to the teeth 135 of the ratchet arm 138. The inner surface of each locking slider 120 defines a flat abutment surface 166 that abuts a back surface of the bottom portion of the ratchet arm 138 in the locked position to hold the teeth 135 in tight engagement with the teeth 134 of the rail 118. The locked position of the slider 120 is shown in each of FIGS. 6-12 (i.e., the slider 120 is slid downward to the bottom of the track 164 in the side of the housing 112).

To unlock the ratchet assembly 136, each of the sliders 120 is slid upward in the side track 164 which brings the abutment surfaces 166 of each into alignment with a ramp section of the arm 138 where there is clearance 168 between the housing wall and the ratchet arm. The clearance 168 allows a user to slide the palm rest 116 up and down to a preferred height. As the palm rest 116 is moved longitudinally with the rails 118 sliding up or down within the elongate housing chamber 113, the bottom portion of the ratchet arm 138 is allowed to flex slightly outward so that the teeth in the ratchet assembly can disengage and the rail 118 can move upward and downward without the ratchet mechanism locking. Once the palm support 116 is positioned at a preferred height, the locking slides 120 are slid down and returned to the locked position that prevents outward flexion of the ratchet arm 138 and locks the respective teeth 134 and 135 tightly against one another.

Figure 13:
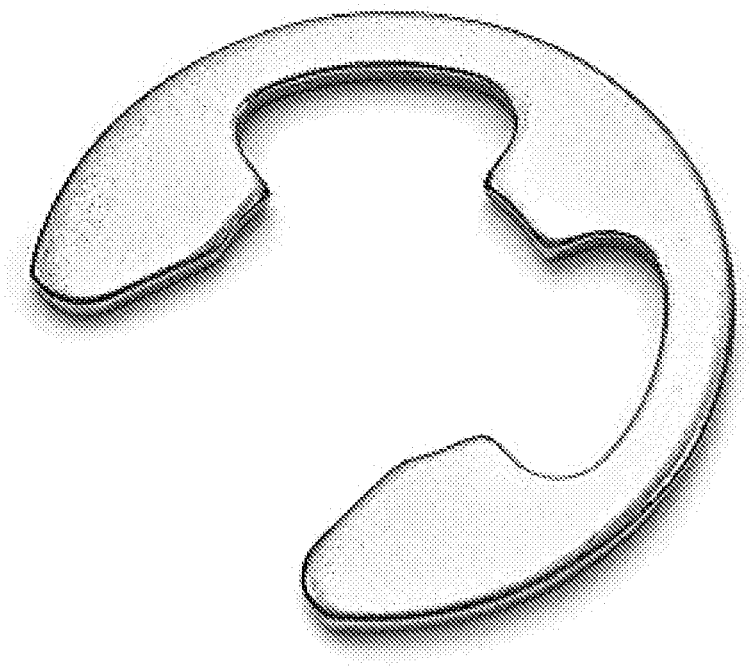
FIG. 13 shows an exemplary retaining ring for use in the disclosed embodiments.

FIG. 13 shows an isolated view of a retaining ring R that may be clipped to the top portion of each threaded post 48/148 of the disclosed device, 10 and 110, to prevent the resistance disc 52/152 from threading off of the top of the post 48/148.

In the embodiment of FIGS. 6-12, each plunger 114 comprises a detachable finger cap 132 attached at the top of a plunger cylinder 170. As shown in the cross-sectional views of FIGS. 9 and 12, the respective finger cap 114 has inner threading 172 that engages with cooperative threads on the cylinder 170 and is fit with an outer resilient pad. Other attachment mechanisms can be employed in place of threading, such as a bayonet connection or snap in engagement.

To replace a spring or a set of springs 28 with springs having a different tension, a user removes the resilient pads on each plunger cap 132, which allows each cap to be gripped and unthreaded from the top of the plunger cylinder. Removal of the cap 132 exposes the inner plunger chamber 155 from which an installed spring 28 can be removed and replaced with a different spring. Additionally, the top of each finger cap 132 includes a textured surface such that removal of the relatively soft resilient pad 132 exposes the textured (and hard) surface for a user to perform callus-building exercises, particularly useful for musicians.

Two exemplary embodiments of the disclosed exerciser are specifically shown and described herein. However, the inventive embodiments are not limited to the exact combinations shown in the device 10 or the device 110. For example, elements from the device 110, such as recesses the support member for containing the knobs can be incorporated into the device 10 with locking cams. Further, the device 10 can include threaded removable finger caps for accessing and replacing bias members.

Additionally, other mechanical techniques for expanding and contracting the distance between the palm support and plungers can be employed. In one particular non-depicted example, the palm support is actuated via rotation of a threaded engagement, such as a threadedly engaged post, conceptually similar to the manner in which the resistance disc 52 is actuated to vary spring tension. In this embodiment, one or more knobs can be housed in the palm support and longitudinally fixed while threadedly engaged with a post whereby rotation of the knob causes it (and the palm support) to travel longitudinally upward or downward on the post.

Altogether, the disclosed embodiments provide a highly adaptable exerciser for compression exercises that is adjustable in height and both finely and coarsely adjustable in resistance force without requiring tools. The device is particularly useful in rehabilitation settings and in the musical arts.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. An exercise device comprising:

a central housing;

a plurality of plungers extending longitudinally from a top side of the housing, each plunger being compressible into the housing against a bias force;

a support member connected to the housing at a bottom side opposite from the plungers, wherein the support member is longitudinally movable relative to the housing between a fully retracted position and a fully extended position, the support member is optionally lockable in an intermediate position longitudinally between the fully retracted position and the fully extended position, and the bias force acting against each plunger is adjustable.

2. The exercise device of claim 1, comprising a locking cam operatively engaged with the support member, the locking cam being movable between a closed position locking the support member to prevent longitudinal movement relative to the housing and an open position releasing and allowing the support member to move longitudinally relative to the housing.

3. The exercise device of claim 1, comprising a ratchet member with spaced apart teeth, wherein the support member includes a section with spaced apart teeth that face the spaced apart teeth of the ratchet member, the ratchet member is movable between a locked position with the ratchet member teeth in engagement with the teeth of the support member preventing longitudinal movement of the support member relative to the housing, and an unlocked position allowing longitudinal movement of the support member relative to the housing.

4. The exercise device of claim 1, wherein the bias force on each plunger is independently adjustable via a tension adjustment knob and is adjustable via removal of a bias member having a first tension profile from the housing and replacement of the bias member with a different bias member having a second tension profile different from the first tension profile.

5. The exercise device of claim 1, wherein the support member comprises one or more longitudinally elongated rails slidably engaged with the housing.

6. The exercise device of claim 5, comprising a ratchet assembly associated with one of the one or more longitudinally elongated rails and being configured to selectively lock and release the respective rail.

7. The exercise device of claim 6, wherein the ratchet assembly comprises a locking slide communicatively associated with a ratchet arm, wherein sliding the locking slide selectively locks and unlocks the ratchet assembly.

8. The exercise device of claim 7, wherein the one of the one or more longitudinally longitudinally elongated rails includes a series of spaced apart teeth on a side facing the ratchet arm on an interior of the housing, and the ratchet arm includes a series of spaced apart teeth configured to engage with the teeth of the the one of the one or more longitudinally elongated rails.

9. The exercise device of claim 8, wherein the ratchet arm includes a ramp on a surface opposite from the teeth, the locking slide is configured to abut the surface of the ratchet arm opposite from the teeth to hold the teeth of the ratchet arm against the teeth of the longitudinally elongated rail to define a locked position, and the locking slide is movable along the ramp to a position releasing the teeth of the ratchet arm from locking engagement with the teeth of the longitudinally elongated rail to define an unlocked position.

10. The exercise device of claim 5, comprising a locking cam associated with one of the one or more longitudinally elongated rails configured to selectively lock and release respective rail from movement relative to the housing.

11. The exercise device of claim 10, wherein the locking cam is rotatable relative to the housing to lock and release the respective rail.

12. The exercise device of claim 11, wherein the locking cam comprises a lever and a lobe section retained to the housing in rotatable engagement about an axis, wherein the cam is rotatable from a locked position with a lobe nose facing the respective rail and an unlocked position with the lobe nose disengaged from the respective rail.

13. The exercise device of claim 1, wherein each plunger includes a resilient pad that is removable to expose a rough textured surface.

14. The exercise device of claim 1, wherein the bias force acting against each plunger is adjustable in two or more independent ways.

15. An exercise device, comprising:

a housing defining one or more elongate chambers;

one or more plungers, each plunger extending in a longitudinal direction, being in operable communication with one elongate chamber and being biased away from the housing;

a tension adjustment member operatively associated with each plunger for varying a bias force on the respective plunger; and a support member connected to the housing a longitudinally opposite side from the one or more plungers, wherein a longitudinal position of the support member relative to the one or more plungers is adjustable, and the support member is lockable in a plurality of different longitudinal positions relative to the housing.

16. The exercise device of claim 15, wherein the support member is longitudinally slidable relative to the housing from a fully extended position defining a maximum size of the device to a fully retracted position defining a minimum size of the device and lockable in any longitudinal position between the fully retracted position and the fully extended position.

17. The exercise device of claim 15, wherein each of the one or more plungers contains an internal bias member and at least a portion of each of the one or more plungers is disengageable to allow removal of the respective internal bias member and replacement with a different bias member having a different tension profile.

18. The exercise device of claim 15, wherein a tension provided on at least one of the one or more compressible plungers is adjustable in at least two separate ways.

19. The exercise device of claim 15, wherein at least one of the one or more plungers includes a removable upper cap that provides optional access to an installed spring when removed.

20. An exercise device, comprising:

a housing defining a plurality of longitudinally elongate chambers;

a plunger associated with each elongate chamber, each plunger being longitudinally compressible into the housing, and being in operable communication with the respective elongate chamber;

a bias member positioned within each elongate chamber in operable communication with the respective plunger to bias the respective plunger away from the housing;

a tension adjustment member operatively associated with each bias member for varying tension of the respective bias member to vary a force required to compress the respective plunger into the housing; and a support member connected to the housing on a side longitudinally opposite from each of the one or more plungers, wherein at least a portion of each plunger is detachable to expose the associated elongate chamber and remove the associated bias member from the housing, and the support member is longitudinally slidable relative to the housing and lockable in a plurality of different longitudinal positions relative to the housing.

* * * * *